US005277207A

United States Patent [19]

Perrier

[11] Patent Number: 5,277,207

[45] Date of Patent: Jan. 11, 1994

[54] DEVICES AND MACHINE FOR TREATING BOTTLES

[76] Inventor: René Perrier, 91 rue Fernand Lafont, 07160 Le Cheylard, France

[21] Appl. No.: 777,359

[22] PCT Filed: Apr. 10, 1991

[86] PCT No.: PCT/FR91/00293

§ 371 Date: Dec. 6, 1991

§ 102(e) Date: Dec. 6, 1991

[87] PCT Pub. No.: WO91/15310

PCT Pub. Date: Oct. 17, 1991

[30] Foreign Application Priority Data

Apr. 11, 1990 [FR] France ..... 90 04651

[51] Int. Cl.[5] ..... B08B 9/08

[52] U.S. Cl. ..... 134/44; 134/62; 134/166 R; 134/182; 134/198; 239/121

[58] Field of Search ..... 134/44, 45, 46, 62, 134/43, 22.1 166 R, 167 R, 182, 183, 198, 155, 186; 239/120, 121, 122, 117; 15/304

[56] References Cited

U.S. PATENT DOCUMENTS

| | | | |
|---|---|---|---|
| 1,825,718 | 10/1931 | Dufford . | |
| 2,279,391 | 4/1942 | Eppler, Jr. | 239/121 |
| 2,298,475 | 10/1942 | Fechheimer | 15/304 X |
| 2,304,050 | 12/1942 | Risser | 15/304 |
| 2,354,308 | 7/1944 | Everett | 15/304 |
| 3,226,757 | 1/1966 | Shea | 15/304 |
| 4,080,974 | 3/1978 | Oag | 134/68 X |
| 4,104,081 | 8/1978 | Totten | 134/68 X |
| 4,174,722 | 11/1979 | Fleenor et al. | 134/62 |
| 4,667,690 | 5/1987 | Hartnig | 134/62 |
| 4,944,647 | 7/1990 | Oleson et al. | 414/411 X |
| 4,967,812 | 11/1990 | Herzog | 239/120 X |

FOREIGN PATENT DOCUMENTS

| | | | |
|---|---|---|---|
| 1560649 | 3/1969 | France . | |
| 2425833 | 1/1980 | France | 134/44 |
| 2489802 | 3/1982 | France . | |
| 44-9194 | 4/1969 | Japan | 134/183 |
| 324087 | 10/1957 | Switzerland . | |
| 2188309 | 9/1987 | United Kingdom | 134/62 |

*Primary Examiner*—Frankie L. Stinson
*Attorney, Agent, or Firm*—Young & Thompson

[57] ABSTRACT

For the treatment of bottles before they are filled, the bottles (2) gripped by a clamp (24), are inverted by the pivoting of the clamp about an inversion axis (28) and in the inverted position undergo injection by means of a nozzle (49). At the same time, the clamp and the bottle are driven rotationally about the axis of a rotary roundabout (13) simultaneously treating a plurality of bottles.

The clamp is articulated on the sides of an individual receptacle (29) which also turns with the roundabout (13) and which discharges into an annular collector (62). The nozzle (49) is situated at the center of a funnel (61) through which the fluid injected into the bottle falls back into the receptacle (29).

Utilization for enhancing the hygiene of the collection circuit for the evacuation or recycling of the treatment fluid.

22 Claims, 7 Drawing Sheets

DEVICES AND MACHINE FOR TREATING BOTTLES

The present invention relates to devices for treating bottles and intended to form part of a bottle treatment machine having movable treatment devices mounted, for example, on a roundabout.

The present invention also relates to a bottle treatment machine of this kind.

A machine of this type is known in which each device comprises a clamp gripping the bottle, for example by its neck, in order to cause it to pivot substantially through 180° until the neck of the bottle is directed downward above a nozzle for injecting a treatment product. The product projected into the bottle, after having struck against and bathed the inside wall of the bottle, falls into a tank formed under all the devices. From this tank the liquid is either conveyed, for example, to the drain or conveyed into a recycling circuit. When a machine of this kind is put into operation, the first injections, which are made while the bottles have not yet arrived, serve to clean the injection circuit before the actual treatment of the bottles.

In the following it will be said that the bottle is in the "upright" position when its neck is directed upward and that it is "inverted" when its neck is directed downward.

The bottle treatment operations must comply with stringent conditions of hygiene. From this point of view the presence of a recovery tank under the machine is scarcely satisfactory. This tank of large dimensions is poorly protected against soiling. It therefore gives rise to a not very salubrious environment around the machine. In addition, its soiling entails direct disadvantages in cases where the liquid has to be recycled. During the cleaning preceding the actual commencement of the operation, the liquid is projected upward in the absence of bottles and falls back in an uncontrolled manner, not necessarily into the tank. The liquid which does fall back into the tank may previously have been in contact with the outside of the machine and have picked up dirt from it.

The aim of the invention is therefore to provide a bottle treatment device and a bottle treatment machine, in which the guiding of the injected fluid is optimized in respect of hygiene and percentage of product recovered after each injection.

According to a first aspect of the invention, the device for treating bottles in the inverted position, comprising a clamp for gripping the bottle and causing it to pivot substantially through 180° about a horizontal axis, a nozzle for injecting fluid into the inverted bottle, and a receptacle for collecting the fluid falling back from the bottle, is characterized in that the receptacle is an individual receptacle and in that the clamp gripping the bottles is carried by at least one pivoting arm articulated to one side of the individual receptacle.

The receptacle can thus be situated just below the neck of the bottle when the latter is in the inverted position, the clamp causing the bottle to pivot in order to cause it to pass from a region situated below the receptacle when the bottle is in the upright position to a region situated just above the receptacle when the bottle is in the inverted position.

The receptacle can be of small size, thus limiting the area of liquid exposed to soiling. The effects of soiling can be further reduced by partly closing the top of the receptacle except at at least one precise place above which the neck of the bottle in the inverted position is situated. The reduced free area of liquid in each receptacle limits losses by evaporation.

According to a second aspect of the invention, the device for treating bottles in the inverted position, comprising a clamp for gripping the bottle and causing it to pivot substantially through 180° about a substantially horizontal axis, a nozzle for injecting fluid into the inverted bottle, and a receptacle for collecting the fluid falling back from the bottle, is characterized in that the receptacle is an individual receptacle, and in that the device comprises, above the fluid injection nozzle, a cap which is movably mounted so as to be moved away by the bottles arriving in the injection position, against the action of return means, said cap being so shaped as to return to the receptacle the fluid injected in the absence of bottles.

This aspect repeats the inventive idea of the individual receptacle of the first aspect, with, in addition, a cap preventing uncontrolled projection of the fluid during injections in the absence of bottles, particularly on the starting-up of a treatment machine equipped with a plurality of such treatment devices.

According to a third aspect of the invention the machine for treating bottles in the inverted position, comprises on a rotary roundabout a series of treatment devices distributed circumferentially and each comprising: a clamp for gripping a bottle and causing it to pivot substantially through 180° about a horizontal axis, a nozzle for injecting fluid into the inverted bottle, the machine additionally comprising means for collecting the fluid falling back from the bottle, and being characterized in that the means for collecting the fluid comprise for each device an individual receptacle fixed to the rotary roundabout, (lacuna) to the rotary roundabout in order to follow the bottle in its displacement between the inlet station on the roundabout and the outlet station of the roundabout.

Other features and advantages of the invention will also emerge from the following description of a non-limitative example.

Figure 1:
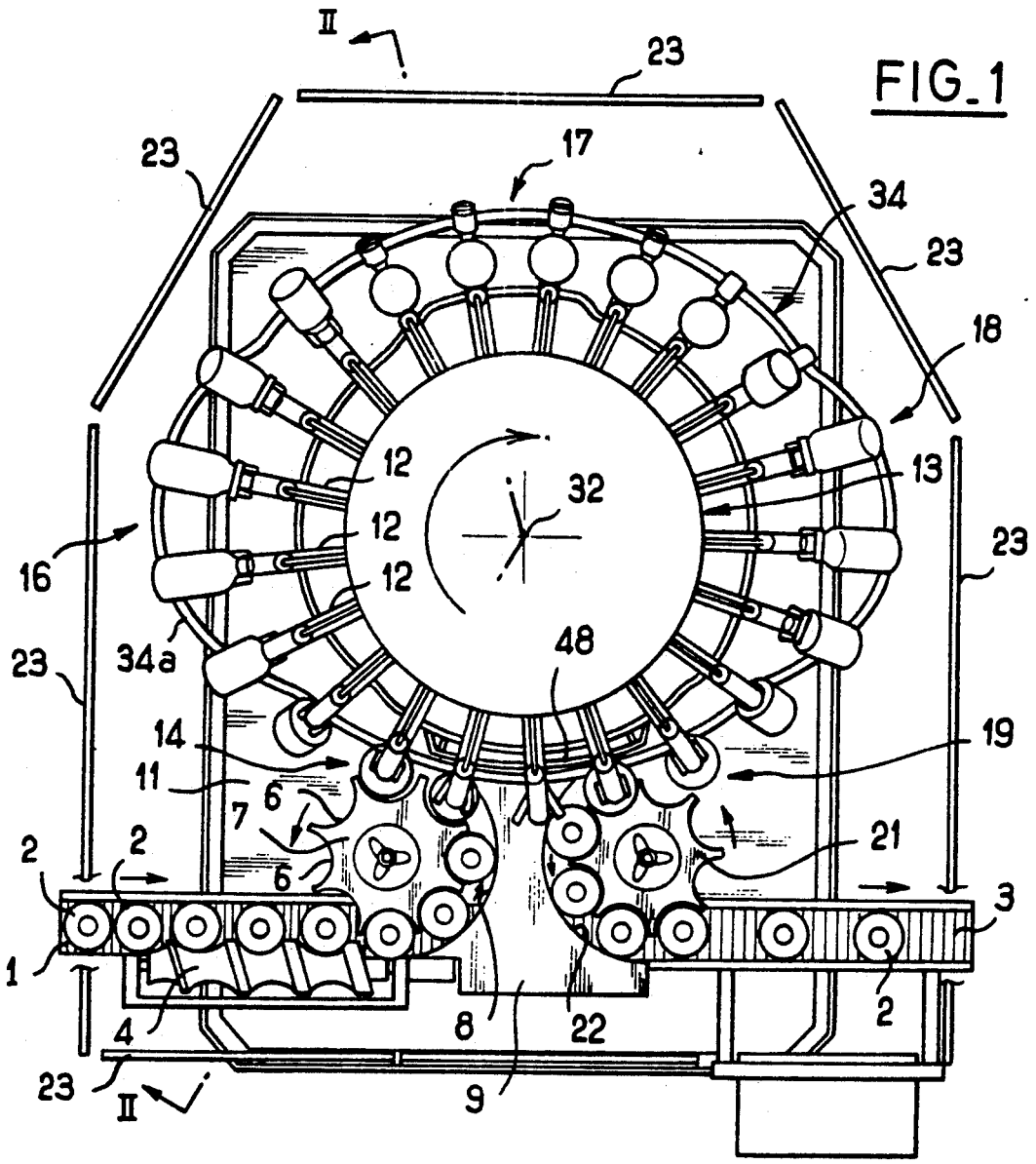
FIG. 1 is a schematic top view of a rotary roundabout treatment machine according to the invention.
Figure 2:
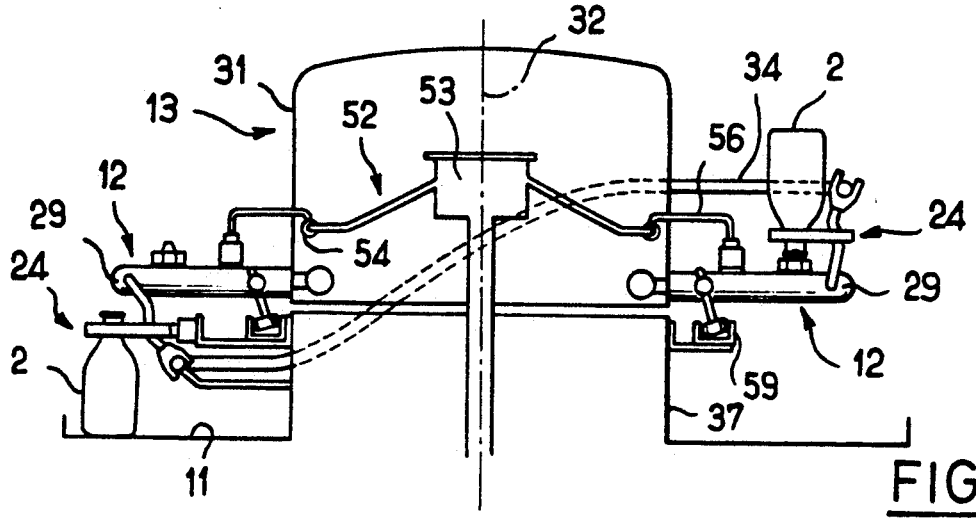
FIG. 2 is a schematic view in axial section of the machine along the line II—II in FIG. 1.

The machine shown in FIGS. 1 and 2 is intended to be inserted in a bottle treatment chain. It comprises an inlet conveyor 1 receiving the bottles 2 coming from the upstream part of the chain, and an outlet conveyor 3 which passes the bottles 2 to the downstream part of the chain.

Along the inlet conveyor 1 is disposed a spacer screw 4 of known type, which gives the successive bottles 2 a spacing and a speed of passage which are predetermined in such a manner as to synchronize the bottles 2 with compartments 6 formed on the periphery of an inlet star wheel 7. The compartments 6 pass above the conveyor 1 and receive the successive bottles 2 in order to propel them along a semicircular trajectory defined by a guide edge 8 of a guide plate 9. This semicircular trajectory, along which the bottles slide with their bottoms on a floor 11, brings the bottles 2 from the inlet conveyor 1 to bottle treatment devices 12 mounted in crown-like distribution on the outer side wall of a rotary roundabout 13. Along the periphery of the roundabout 13 the treatment devices have a circumferential spacing relative to one another which corresponds to the gap between successive bottles on the star wheel 7.

Via the rotation of the roundabout 13 the treatment devices 12 pass in succession through a bottle gripping station 14, a bottle inversion station 16, an injection station 17, a bottle re-erection and draining station 18, and a station 19 for transferring the treated bottles to an outlet star wheel 21, which is similar to the inlet star wheel 7 and which brings the treated bottles from the transfer station 19 to the outlet conveyor 3 on a semicircular path along which the bottles slide with their bottoms on the floor 11 and follow another curved guide edge 22 of the plate 9.

The outlet conveyors 2 and 3 are preferably physically composed of a single conveyor, above which the plate 9 is fixed.

The machine is protected and soundproofed by peripheral panels 23, at least some of which are transparent and/or can be opened for maintenance and detailed inspection purposes.

Figure 3:
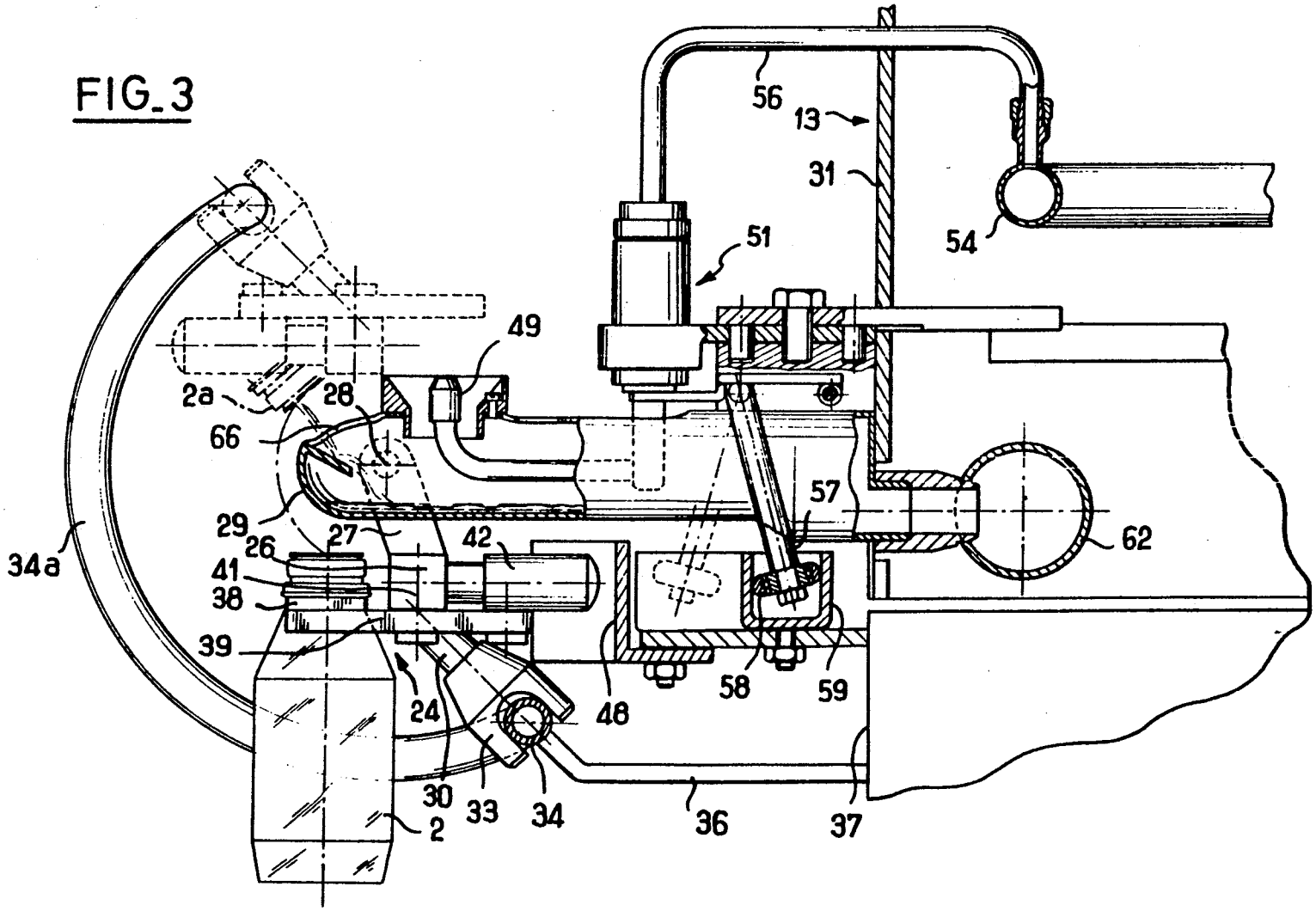
FIG. 3 is a view in elevation, partly in section, of a treatment device of the machine shown in FIGS. 1 and 2, the bottle being in the upright position.
Figure 4:
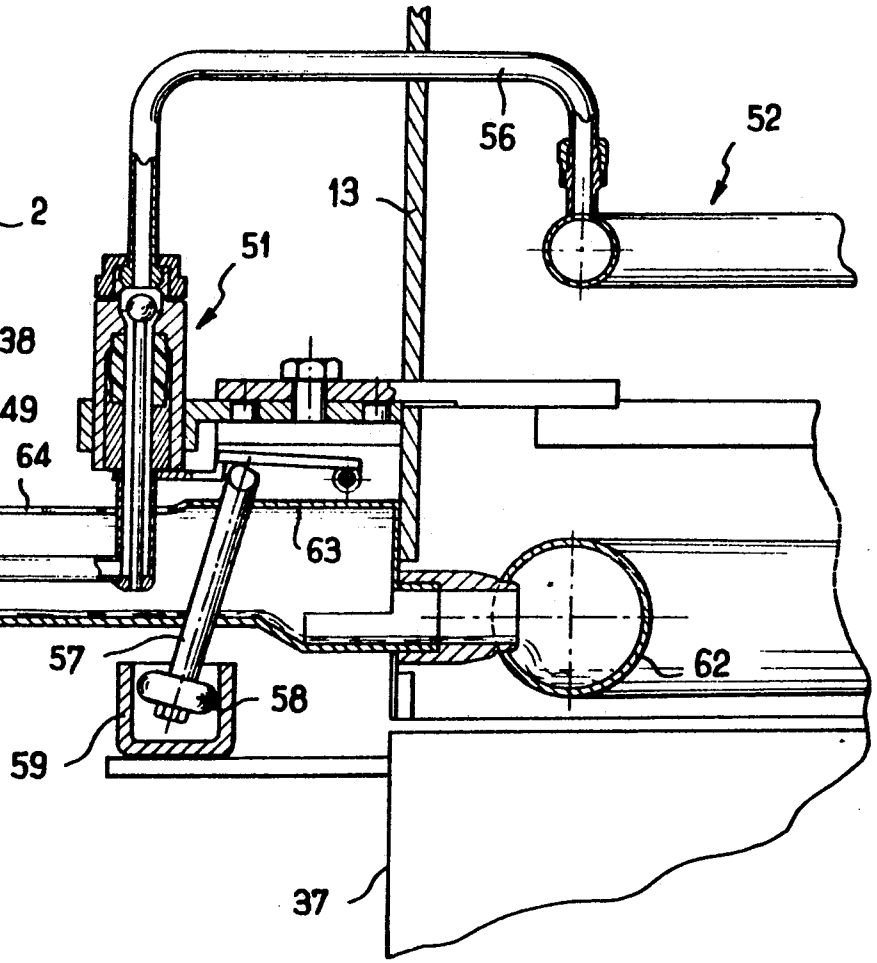
FIG. 4 is a view similar to FIG. 3, but showing the bottle subjected to an injection in the inverted position.

As shown in FIGS. 2 to 4, each treatment device comprises a clamp 24, the function of which is to grip by its neck the bottle 2 arriving in front of it in the gripping station, and then to handle the bottle during the inversion and re-erection operations, and finally to release the bottle at the transfer station 19.

Figure 7:
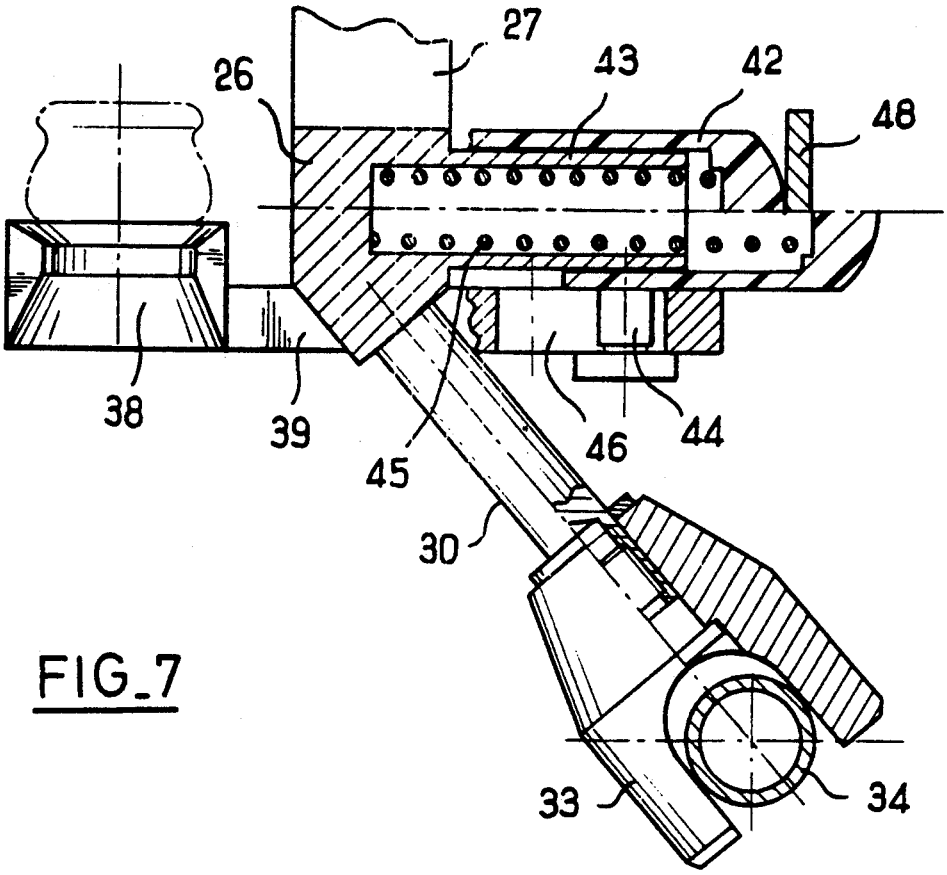
FIG. 7 is a view of the clamp in lateral elevation, in two different positions, with partial sections and cutaway sections.

Each gripper clamp thus comprises a clamp body 26 (FIGS. 5 to 7) in the form of a clevis comprising two arms 27 articulated on a substantially horizontal common axis 28 to two opposite sides of a body 29 of the treatment device. The body 29 is fixed to the rotary frame 31 of the roundabout (FIGS. 2 and 3), and it is extended radially toward the outside from the rotary frame 21, in relation to the substantially vertical axis of rotation 32 of the roundabout 13. The axis 28 is situated close to the radially outer end of the body 29. The axis 28 is called the inversion axis, because it is around that axis that the bottles 2 pivot for their inversion and re-erection movements. For this purpose the clamp body 26 carries a finger 30 ending in a fork 33, preferably made of plastic material having a low coefficient of friction and good wear resistance. A movement control bar 34 is engaged in the fork 33. As shown in FIG. 1, the movement control bar 34 extends around the roundabout 13 and, as shown in FIG. 3, it is fixed for example by brackets 36 to the fixed frame 37, which is situated under the rotary frame 31 and rotatably supports the latter.

In the representation in FIG. 3 the movement control rail 34 is viewed as if, starting from the sectional plane of FIG. 3, the observer's viewing direction were not a straight line at right angles to the plane of the drawing, but a curve centered on the axis of rotation of the roundabout. It is thus that part 34*a* of the rail 34 that controls the inversion movement of the bottles 2, and which is in reality a helix having a circular axis, appears in FIG. 3 as being a semicircle centered on the inversion axis 28.

Figure 6:
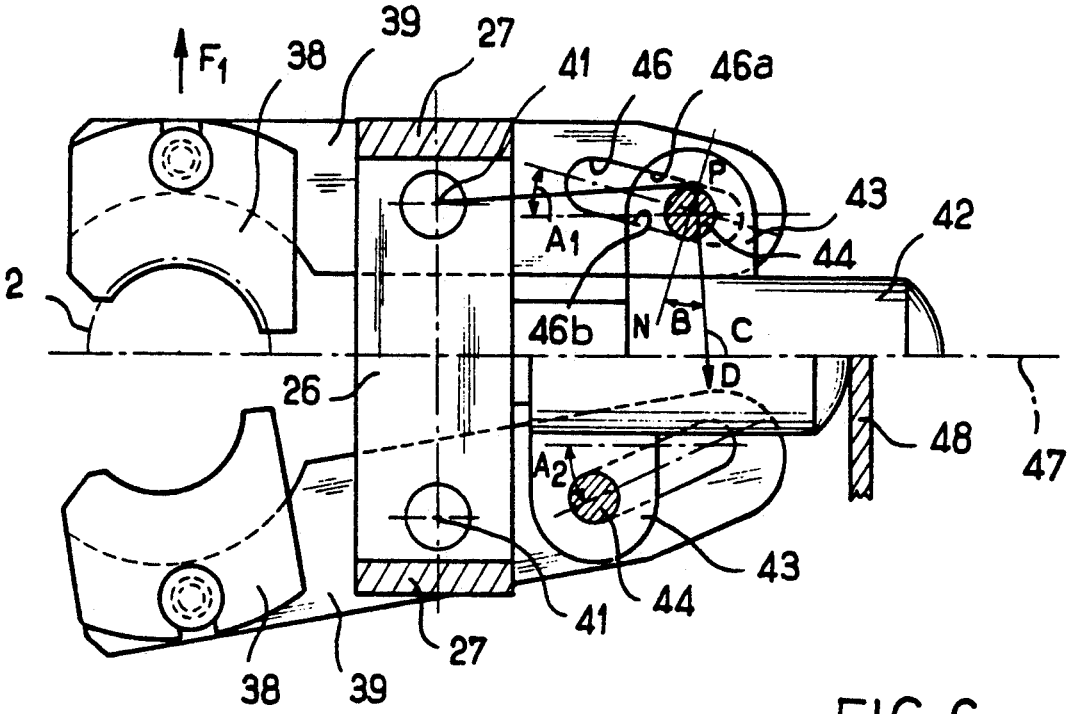
FIG. 6 is a top view of the clamp, with the arms and tenons in section, and in two different positions.

As shown in FIG. 6, the clamp 24 comprises two jaws 38 of plastic material, each fixed to a rigid branch 39. The two branches 39 are articulated to the body 26 on two axes 41 parallel to one another and at right angles to the inversion axis 28. The jaws 38 are thus movable between a gripping position (top part of FIG. 6), in which they are relatively close to one another and can retain between them the neck of a bottle, and a release position (bottom part of FIG. 6), in which they are relatively distant from one another and enable the neck of a bottle coming from the inlet star wheel 7 to be engaged between them, or to be disengaged from them in order to be taken up by the outlet star wheel 21.

The clamp also comprises an actuating slide 42, consisting of a cap of plastic material mounted slidably on a cylindrical end piece 43 of the clamp body 26. The cap 42 carries laterally two opposite lugs 43, each of which in turn carries rigidly a tenon 44 extending parallel to the axes 41. Each of the tenons 44 is engaged in a slot 46 in one of the branches 39. Each slot 46 has opposite longitudinal edges 46*a* and 46*b*, which are parallel, rectilinear and inclined relative to the displacement axis 47 of the actuating slide 42. The branches 39, and in particular the jaws 38, axes 41 and slots 46, are disposed symmetrically relative to the axis 47. Thus, the edges 46*a* and 46*b* of the inclined slots 46 form a ramp for the actuation of the jaws 38 by the tenons 44 when the slide 42 is displaced along its axis 47, in such a manner that the jaws 38 pivot toward their gripping position and toward their release position respectively. As shown in FIG. 6, the inclination of the slots 46 relative to the direction 47 varies depending on the pivoting of the branches 39, but always remains oriented in the same direction. In other words, in the example illustrated, it can be seen in FIG. 6 that, whatever the position of the jaws 38, the slots 46 converge toward the axis 47 in the opposite direction to the jaws 38.

The two systems of tenons 44 and slots 46 constitute irreversible means of transmission between the slide 42 and the jaws 38. This means that it is impossible to displace the slide 42 by applying a force to the jaws 38. Irreversibility is particularly desirable in respect of the opening of the jaws 38 from the gripping position shown at the top in FIG. 6. A force Fl exerted on the jaws 38 in the opening direction from the gripping position gives rise to a support point P between the edge 46*a* and the tenon 44, and tends to displace said point P in the direction D which is circumferential relative to the axis 41 of the branch 39. In order to ensure the above-mentioned irreversibility the angle B between the direction D and the normal N to the edge 46*a*, starting from the point P, is an acute angle of small value, whereas the angle C between the direction D and the displacement axis 47 is close to 90°.

In the example illustrated the transmission means are irreversible in all positions of the jaws and in respect of both their directions of movement.

It is therefore the slide 42 that controls the two directions of movement of the jaws. A return spring 45 (FIG. 7) is mounted in the tubular end piece 43 of the clamp body 26 and permanently urges the slide 42 toward a projecting position corresponding to the gripping position of the jaws 38.

The treatment machine additionally comprises a cam 48 made in the form of a flat iron section (see also FIG. 1), which cooperates with the free end of the slide 42 to drive in the slide 42 against the action of the return spring 45 when the jaws 38 have to be displaced from their gripping position to their release position, as shown at the bottom in FIG. 6.

As shown in FIG. 1, the cam 48 is situated only in that region of the perimeter of the roundabout 13 in which the gripper jaws of each treatment device have to be displaced from the gripping position to the release position (transfer station 19), to be held in the release position (passage from the transfer station to the gripping station) and then to be brought back to the gripping position (gripping station 14). Along the remainder of the perimeter of the roundabout 13, as also shown at the top in FIG. 6, the return spring 45 holds the slide 42 in the position in which the jaws 38 bear against the neck 2 of a bottle undergoing treatment. The spring 45 need not be very powerful; it is sufficient for it to be able to bring the jaws 38 reliably into contact with the neck 2, without necessarily exerting a clamping action on the neck of the bottle 2; in fact, by virtue of the irreversibility of the transmission means 44, 46, the bottle 2 cannot, through the action of its own weight or of its inertia during handling operations, bring about the opening apart of the jaws 38 or become disengaged from the jaws 38.

Thus, as illustrated in FIG. 3, each clamp 24 is able to grip a bottle 2 in the upright position under the body 29 and to pivot it through 180° around the free end of the body 29 under the control of the control bar 34, in order to bring the bottle into an inverted position (FIG. 4), in which its neck is situated just above a fluid injection nozzle 49. The nozzle 49 is connected by means of a valve 51, fixed to the body 29, to a pressurized supply device 52 which is installed inside the roundabout 13 and which may for example include a pump 53 (FIG. 2) delivering into an annular pipe 54 to which are connected all the connections 56 to the valves 51 of all the treatment devices 12 of the machine.

Each valve 51 is controlled by a lever 57 which is movable between a closed valve position, shown in FIG. 3, and an open valve position shown in FIG. 4. The lever carries at its end a roller 58 which is engaged in a U-shaped control rail 59, which is fixed to the fixed frame 37 of the machine and extends around said frame, as can be seen in FIG. 1. The control rail 59 is circular and centered on the axis 32 of the rotary roundabout, except along the injection station 17, in such a manner as to cause each valve 51 to pass in the open position to the injection station 17 and to hold it in the closed position along all the other stations of the treatment machine.

Consequently, when a bottle 2 is at the injection station, as illustrated in FIG. 4, the nozzle 49 delivers a jet of fluid into the interior of the inverted bottle 2, through its neck. This fluid strikes the inside wall of the bottle 2 and trickles along the latter before passing out of the bottle 2 by way of the neck of the latter.

The fluid thus flowing out is collected through a funnel 61 which is situated just below the neck of the bottle 2 and which surrounds the nozzle 49 with a certain radial clearance between the outside wall of the nozzle 49 and the inside wall of the funnel 61. The aperture defined by the funnel 61 gives access to the interior of the body 29, which constitutes an individual receptacle for the collection of the fluid falling back from the bottle 2.

The expression "individual receptacle" is intended to designate a receptacle of relatively small size, allocated to a single treatment device and turning with the roundabout 13 so as to remain under the necks of the bottles 2 undergoing treatment, particularly along the injection station 17.

At its radially inside end the receptacle 29 is in communication with an annular collector 62 mounted in the rotary roundabout 13 for the purpose of collecting the liquid falling back from the bottles 2 and coming from all the receptacles 29.

In the example illustrated this fluid is a liquid. It may be a rinsing liquid such as water, which will be conducted from the collector 62 to the drain. It may also be a bottle coating liquid which is relatively expensive and which will be conducted from the collector 62 via a filtration and recycling device toward pump 53 (FIG. 2). In a manner not illustrated, the fluid injected by the nozzle 49 may be a gas which it is not desired to discharge in large amounts into the atmosphere, and in this case the collector 62 is connected to a suction source.

The receptacle 29 has a top closure 63 in which, in addition to the opening defined by the funnel 61, there are disposed an opening 64 in which the base of the valve 51 is engaged, and a drip collection opening 66. The latter is disposed in the radially outer end of the receptacle 29, that is to say that end of the receptacle 29 which is surrounded by the trajectory of the clamp 24 and of the bottle 2 carried by it between the upright and inverted positions of the latter. FIG. 3 shows in dot-dash lines a position 2a assumed by the bottle 2 in the course of its return travel from the inverted position to the upright position along the bottle re-erection station 18 shown in FIG. 1. The position 2a, which is inclined less than 90° relative to the inverted position, promotes the draining of the bottle after the injection undergone along the injection station, and the receptacle 29 collects the product of this draining by way of the opening 66.

Figure 5:
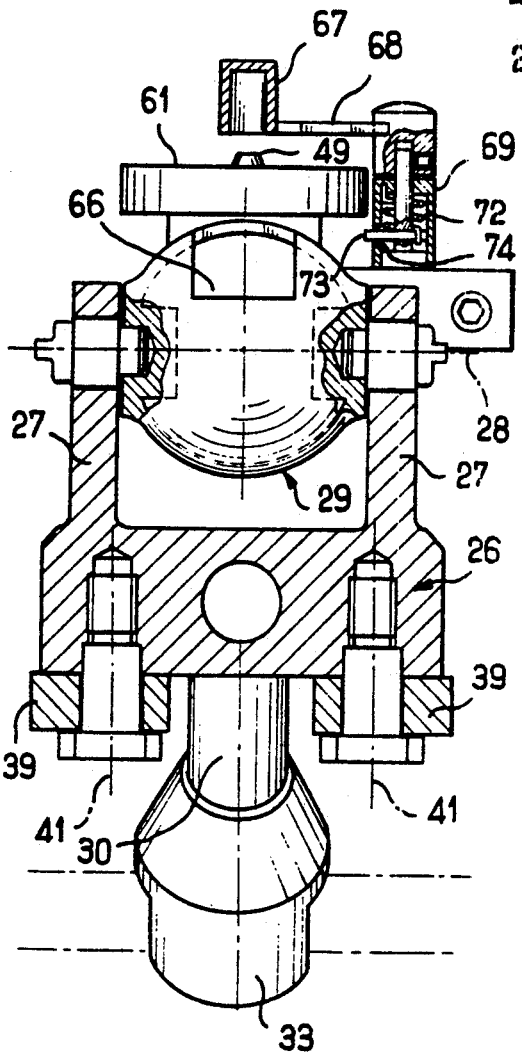
FIG. 5 is a front view of the device with partial in sections and cutaway sections.
Figure 8:
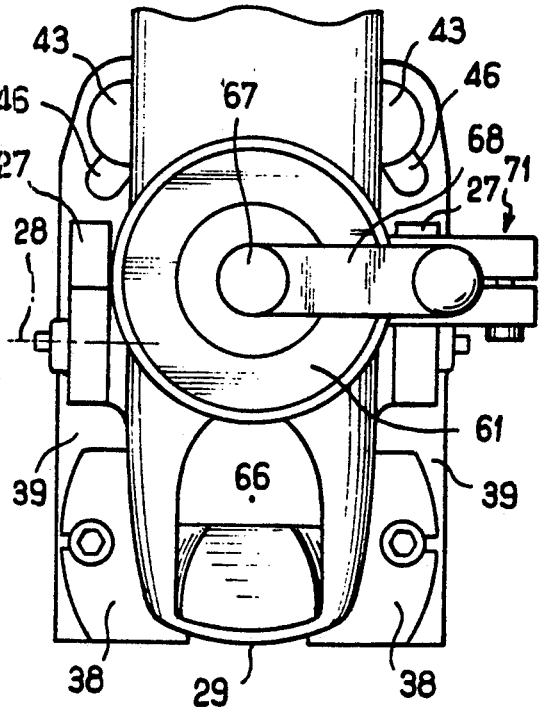
FIGS. 8 and 9 are top views of the front part of the device, without a bottle being present and with a bottle in the inverted position respectively.
Figure 9:
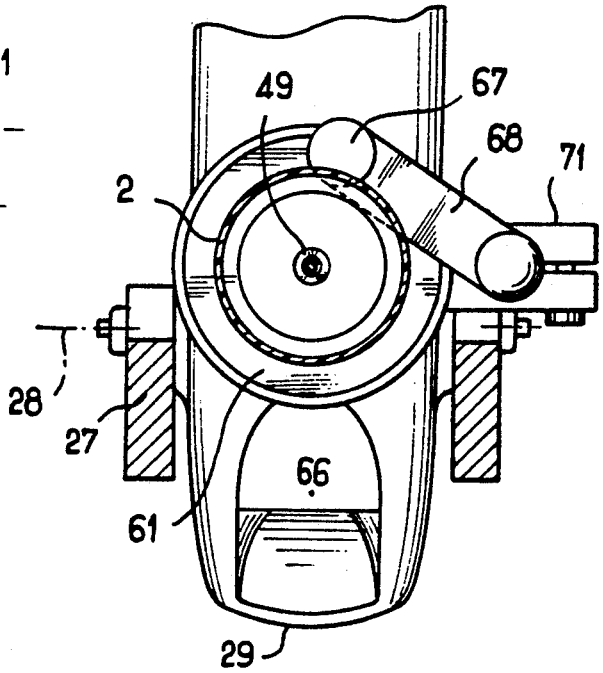

As shown in FIGS. 5, 8 and 9, a cap 67 is carried above the funnel 61 by an arm 68, which at its opposite end to the cap 67 is rotatably supported in a bearing 69 clamped in a collar 71 welded on one side of the body-receptacle 29. The cap 67 is thus movable between the position shown in FIGS. 5 and 8, in which it is situated just above the nozzle 49, and a disengagement position of the nozzle 49 and funnel 61, which is shown in FIG. 9.

In the bearing 69 is mounted a helical spring 72 which operates by winding and which returns the cap 67 to the position in which it is situated above the nozzle 49. If an injection of liquid takes place in the absence of bottles 2, for example at the commencement of the operation of the machine, the injection is made into the interior of the cap, which is shaped so as to return the fluid thus injected to the receptacle 29, via the funnel 61. When a bottle reaches the inverted position (FIG. 9), it abuts against the cap 67 or the arm 68 and thus pushes them back to the position which disengages the funnel 61 against the action of the return spring 72. The injection is therefore made into the bottle. A snug 73 is rotatable with the cap 67 and with the arm 68 inside the bearing 69 and travels in a circumferential slot 74 in the bearing 69, the circumferential ends of said slot forming stops limiting the angular travel of the cap 67 about the axis defined by the bearing 69.

The valve 51 will now be described in detail with reference to FIGS. 10 and 11.

The valve 51 comprises a stationary half-body 76 having a tubular general shape, which is fixed to the body-receptacle 29 by means of a collar 77 and a bracket 78. At one of its ends the stationary half-body 76 is leaktightly connected to the connection 56. The other end of the stationary half-body 76 is shaped as a skirt 91 in which a movable half-body 79 is mounted so as to slide axially. The two half-bodies 76 and 79 together form a valve body defining a flow path 81 between an opening 82 associated with the stationary half-body 76 and bringing the latter into communication with the connection 56, and an opening 83 formed through the side wall of the movable half-body 79, whose end opposite to the stationary half-body 76 is closed by an end wall 84.

The valve 51 additionally includes a spherical closure means 86 mounted in the stationary half-body 76 between the opening 82 of the latter and a seat 87 of conical general shape formed on the inside wall of the stationary half-body 76 in such a manner as to widen out toward the opening 82, that is to say in the opposite direction to the other half-body. The spherical closure means 86 is rigidly fixed to one end of an axial rod 88, the other end of which is leaktightly screwed into a tapped hole 90 in the end wall 84 of the movable half-body 79. For the purpose of effecting this screwing during assembly, the closure means 86 is provided on its side facing the opening 82 with a slot 89, in which the end of a screw driver can be inserted when the attachment to the connection 56 has not yet been made. The rod 88 thus extends through a part of the stationary half-body 76 and through the entire axial length of the movable half-body 79.

Figure 10:
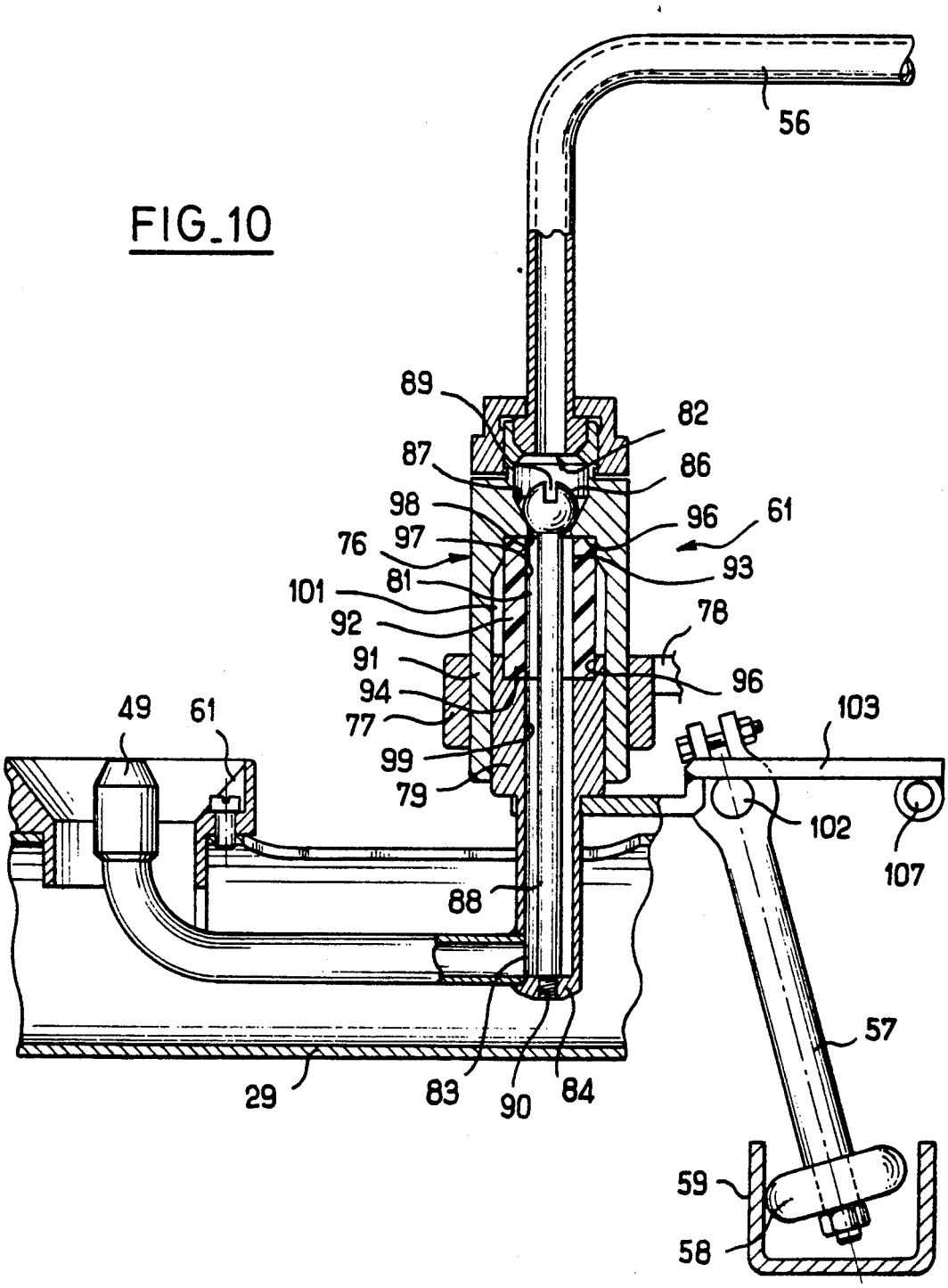
FIGS. 10 and 11 are views in axial section of the central part of the device, at rest and in the course of injection respectively.
Figure 11:
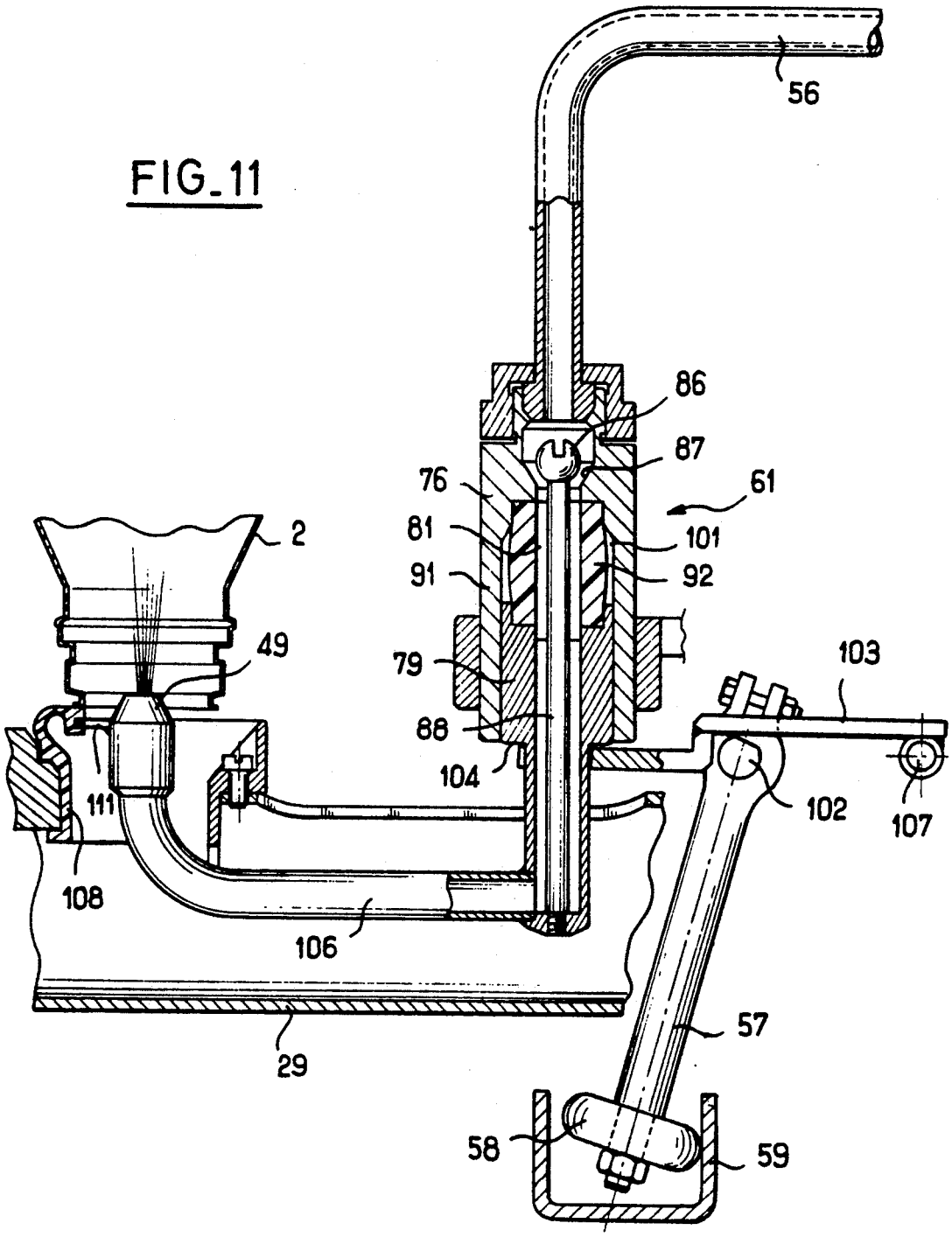

Through the sliding of the movable half-body 79 in the terminal skirt 91 of the stationary half-body 76, the closure means 86 is movable between the closed position shown in FIG. 10, in which it bears leak-tightly against the seat 87, and an open position shown in FIG. 11, in which it has been moved away from the seat 87, while the movable half-body 79 is in a retracted position inside the skirt 91.

The valve 51 also includes means for returning the closure means 86 to the closed position, and sealing means between the two half-bodies 76 and 79. These return means and sealing means consist of a single piece, namely a sleeve 92 of silicone plastic material, which is mounted around the rod 88 with, between them, an annular space defining a part of the flow path 81. The sleeve is inserted axially between an annular shoulder 93 stationary half-body 76 and an annular shoulder 94 on the movable half-body 79. The sleeve 92 is compressed elastically in the axial direction between the shoulders 93 and 94, which has the effect of causing it to bear leaktightly against each of the two shoulders 93 and 94 and to urge the two half-bodies 76 and 79 axially apart, and therefore applying the closure means 86 against its seat 87 with a force substantially corresponding to the elastic compressive force of the sleeve in this relative position of the two half-bodies.

Each half-body 76 and 79 has around its shoulder 93 and 94 respectively a centering surface 96 cooperating with the corresponding end of the outside side surface of the sleeve 92 to center the latter on the general axis of the valve 61 (sic). The sleeve 92 has a cylindrical inside surface 97 extending over its entire axial length and having the same diameter as bores 98 and 99 adjoining the sleeve and belonging to the half-bodies 76 and 79 respectively. Said inside surface 97 is thus connected continuously to the bores 98 and 99 in order to give the flow path, between the closure means 86 and the opening 83, a smooth configuration of annular section, the rod 88 being itself cylindrical with a diameter smaller than the inside diameter of the wall 97 and of the bores 98 and 99.

A clearance 101 is provided around the sleeve 92 between the two centering surfaces 96, in order to enable the sleeve 92 to swell slightly in the outward direction when, as illustrated in FIG. 11, it is axially compressed in order to cause the closure means 86 to pass to the open position.

In the example illustrated, the sleeve 92 has an outside surface which is cylindrical and coaxial to its cylindrical inside surface 97, so that the sleeve 92 can be produced by cutting up a simple tube of silicone plastic material.

In order to effect the passage of the closure means 86 to the open position against the action of the return force exerted by the sleeve 92, the actuating lever 57 is axially fastened to a cam 102 which selectively effects the displacement of a lever 103, which has an axis 107 fastened to the receptacle 29 and which is supported, at a distance from the axis 107, on a shoulder 104 on the movable half-body 79.

As also shown in FIG. 11, when the half-body 79 is actuated in the direction of the opening of the closure means 86, this gives rise to an upward movement of the nozzle 49, which is rigidly connected to the movable half body 79 in such a way as to be in leaktight communication with the opening 83. This may cause the nozzle 49 to penetrate slightly into the neck of the bottle 2, and it reinforces the accuracy of the injection.

As shown in a half-view in FIG. 11, it is possible to contemplate fitting a sealing bellows 108 in the funnel 61, the movable portion of which bellows is supported by a rigid ring 109 connected to the nozzle 49 by rigid bars 111. When the nozzle 49 rises together with the half-body 79, it applies the bellows 108 leaktightly against the neck of the bottle, as illustrated. This is advantageous when the fluid used is a gas which it is desired to collect in the receptacle 29 by suction.

A pipe 106 connecting the nozzle 49 to the opening 83 extends freely inside the body-receptacle 29.

The valve 51 provides the advantage of having a smooth flow path 81 which does not encourage the accumulation of deposits, and of not having a dynamic seal for controlling the valve, that is to say of not requiring one of the half-bodies to have, passing leaktightly through it, a member controlling the closure means.

The operation of the treatment machine will now be explained:

The bottles 2 brought by the inlet conveyor 1 and suitably spaced by the spacer screw 4 are delivered by the inlet star wheel 7 to the successive treatment devices 12. The cam 48 controls the closing of each clamp 24 at the moment when the inlet star wheel 7 has placed a bottle between its jaws.

After the closing of a clamp, the guide bar 34 controls, by its helical region 34a, the progressive inversion of the bottle 2 in question, this inversion being completed at the beginning of the injection station 17 slightly before the control rail 59 brings about the opening of the valve 51 and consequently the injection of fluid through the nozzle 49. After the injection the bottle is held for a certain time in the inverted position in order to enable it to drain, and thereupon the control bar 34 brings about the re-erection of the bottle along the re-erection station 18 until the bottle is received in one of the compartments of the outlet star wheel 21, whereupon the cam 48 brings about the opening of the clamp to enable the bottle to be conducted from the transfer station 19 to the outlet conveyor 3.

Figure 12:
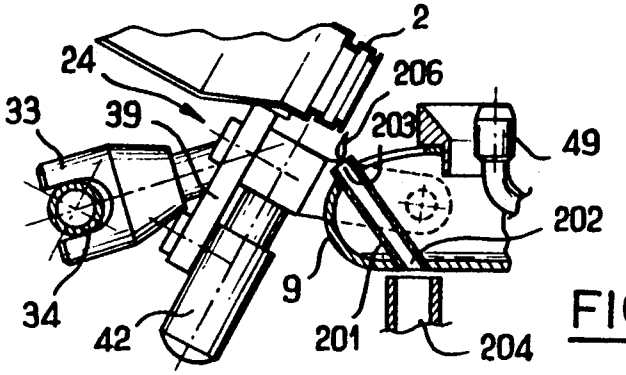
FIG. 12 is a detail view of another embodiment of the invention.

In the example of embodiment shown in FIG. 12 a tube 201 is mounted through the receptacle 29 in such a manner as to have an outlet end 202 leading to the base of the receptacle 29 and an inlet end 203 leading out at a point facing the neck of the bottle 2 when the latter is inclined at about 110° to 120° from its upright position. In addition, a suction nozzle 204 is provided in a fixed position on the machine, facing which the end 202 is situated when the bottle 2 has the aforesaid inclination during the return movement toward the upright position. The nozzle 204 operates continuously and the suction produced by it is thus transmitted to the end 203 at the moment when the last drops 206 fall from the bottle 2. These drops are discharged through the tube 201 and the nozzle 204 toward a collection vessel or to the drain.

The invention is obviously not limited to the example described and illustrated. The slots 46 in the clamp, instead of being rectilinear, could have a curvature compensating for the pivoting of the branches 39 about their axes 41, in such a manner that that region of the slots 46 in which the tenons 44 are situated will always have the same inclination relative to the axis 47.

I claim:

1. Device for treating bottles in an inverted position, comprising a clamp (24) for gripping a bottle (2) and causing it to pivot substantially through 180° about a substantially horizontal axis (28) a nozzle (49) for injecting fluid into the thus-inverted bottle, and a receptacle (29) for collecting the fluid falling back from the bottle, characterized in that the receptacle is an individual receptacle (29) and in that the clamp (24) gripping the bottles is carried by at least one pivoting arm (27) articulated to one side of the individual receptacle.

2. Device according to claim 1, characterized in that an receptacle comprises, at an end surrounded by a trajectory of the clamp, an opening (66) for collecting the liquid fluid draining off during a re-erection movement of the bottles (2) from the inverted position to the upright position.

3. Device according claim 1, characterized in that the receptacle is at least partly closed at the top.

4. Device according claim 1, characterized in that it comprises, above the fluid injection nozzle (49), a cap (67) which is movably mounted so as to be moved away by the bottles (2) arriving in the injection position, against the action of return means (72), said cap being so shaped as to return to the receptacle (29) the fluid injected in the absence of bottles.

5. Device according to claim 1, characterized in that the receptacle carries an injection control valve (51).

6. Device for treating bottles in an inverted position, comprising a clamp (24) for gripping a bottle (2) and causing it to pivot substantially through 180° about a substantially horizontal axis (28), a nozzle (49) for injecting fluid into the thus-inverted bottle (2), and a receptacle (29) for collecting the fluid falling back from the bottle, characterized in that the receptacle is an individual receptacle (29), and in that the device comprises, above the fluid injection nozzle, a cap (67) which is movably mounted so as to be moved away by the bottles (2) arriving in the injection position, against the action of return means (72), said cap being so shaped as to return to the receptacle the fluid injected in the absence of bottles.

7. Device according to claim 6, characterized in that the nozzle (49) is mounted substantially at the center of an opening (61) provided in the top of the receptacle (29) for the passage of the fluid leaving the bottle in the inverted position.

8. Device according to claim 7, characterized in that the receptacle comprises, at an end surrounded by the trajectory of the clamp, a drip collection opening (66) for collecting the liquid fluid dripping off during the return pivoting of the bottles.

9. Machine for treating bottles in an inverted position, comprising on a rotary roundabout (13) a series of treatment devices (12) distributed circumferentially and each comprising: a clamp (24) for gripping a bottle (2) and causing it to pivot substantially through 180° about a substantially horizontal axis (28), a nozzle (49) for injecting fluid into the thus-inverted bottle (2), the machine additionally comprising means for collecting the fluid falling back from the bottle, characterized in that the means for collecting the fluid comprise for each treatment device an individual receptacle (29) fixed to the rotary roundabout (13).

10. Machine according to claim 9, characterized in that the clamp (24) gripping the bottles in each device (12) is carried by at least one pivoting arm (27) articulated to one side of the individual receptacle (29).

11. Machine according to claim 9, characterized in that the receptacle (29) has a shape radially elongated toward the outside from a rotary frame (31) of the roundabout (13), the clamp (24) pivoting about the radially outer end of the (29).

12. Machine according to claim 9, characterized in that each receptacle (29) has provided in a region surrounded by the trajectory of the clamp, an opening (66) for collecting the liquid fluid draining off during a re-erection movement of the bottles from the inverted position to the upright position.

13. Machine according to claim 12, characterized in that the collection opening (61) is close to the trajectory of the neck of the bottle and is connected to suction means.

14. Machine according to claim 9, characterized in that the receptacle (29) has a partial top closure (63).

15. Machine according to claim 14, characterized in that the nozzle (49) of each device (12) is mounted substantially at the center of an opening (61) provided in the top of the receptacle in order to collect in the receptacle the fluid falling back from the bottle.

16. Machine according to claim 9, characterized in that each device (12) comprises means (108, 109, 111) for effecting sealing between the neck of each inverted bottle (2) and the receptacle (29) around the nozzle (49).

17. Machine according to claim 16, characterized in that the sealing means are in driving relationship with the nozzle (49), which is movable axially in synchronism with the passage of an injection tap between an open position and a closed position, this movement of the nozzle applying the sealing means against the neck and respectively moving the sealing means away from the neck.

18. Machine according to claim 9, characterized in that the receptacles (29) are connected to suction means.

19. Machine according to claim 9, characterized in that it comprises, above the fluid injection nozzle (49) of each device (12), a cap (67) which is movably mounted so as to be moved away by the bottles arriving in the injection position, against the action of return means (72), said cap being so shaped as to return to the receptacle (29) the fluid injected in the absence of bottles.

20. Machine according to claim 9, characterized in that the receptacle of each device (12) carries an injection control tap (51).

21. Machine according to claim 9, characterized in that in the upright position the bottles (2) are situated under the individual receptacles (29).

22. Machine according to claim 9, characterized in that the receptacle (29) is provided with a tube (201) which has an inlet end (203) adjacent to the neck of the bottle when the latter makes its return movement to the upright position, and an outlet end (202) which coincides with a fixed suction nozzle (204) in this stage of the movement of the bottle.

* * * * *